US005821958A

United States Patent [19]

Lim

[11] Patent Number: 5,821,958

[45] Date of Patent: Oct. 13, 1998

[54] ACOUSTIC INK PRINTHEAD WITH VARIABLE SIZE DROPLET EJECTION OPENINGS

[75] Inventor: Martin G. Lim, Union City, Calif.

[73] Assignee: Xerox Corporation, Stamford, Conn.

[21] Appl. No.: 557,785

[22] Filed: Nov. 13, 1995

[51] Int. Cl.[6] ..... B41J 2/135

[52] U.S. Cl. ..... 347/46

[58] Field of Search ..... 347/46, 47, 75, 347/87, 89

[56] References Cited

U.S. PATENT DOCUMENTS

| | | | |
|---|---|---|---|
| 4,308,547 | 12/1981 | Lovelady et al. | 346/140 R |
| 4,697,195 | 9/1987 | Quate et al. | 346/140 R |
| 4,719,476 | 1/1988 | Elrod et al. | 346/140 R |
| 4,719,480 | 1/1988 | Elrod et al. | 346/140 R |
| 4,748,461 | 5/1988 | Elrod | 346/140 R |
| 4,751,529 | 6/1988 | Elrod et al. | 346/140 R |
| 4,751,530 | 6/1988 | Elrod et al. | 346/140 R |
| 4,751,534 | 6/1988 | Elrod et al. | 346/140 R |
| 4,959,674 | 9/1990 | Khri-Yakub et al. | 346/140 R |
| 5,028,937 | 7/1991 | Khuri-Yakub et al. | 347/46 |
| 5,041,849 | 8/1991 | Quate et al. | 347/46 |
| 5,077,565 | 12/1991 | Shibaike et al. | 347/47 X |
| 5,087,931 | 2/1992 | Rawson | 346/140 R |
| 5,111,220 | 5/1992 | Hadimioglu et al. | 346/140 R |
| 5,121,141 | 6/1992 | Hadimioglu et al. | 346/140 R |
| 5,122,818 | 6/1992 | Elrod et al. | 346/140 R |
| 5,142,307 | 8/1992 | Elrod et al. | 346/140 R |
| 5,159,348 | 10/1992 | Dietl et al. | 347/89 |
| 5,216,451 | 6/1993 | Rawson et al. | 346/140 R |
| 5,450,107 | 9/1995 | Rawson | 347/46 |

*Primary Examiner*—Benjamin R. Fuller
*Assistant Examiner*—C. Dickens
*Attorney, Agent, or Firm*—Robert A. Burtzlaff

[57] ABSTRACT

An acoustic ink printhead includes a substrate having an inlet side, an outlet side, and a plurality of acoustic lenses acoustically coupled to a substrate. Each acoustic lens has an identical focal length for focusing acoustic energy at an associated position adjacent to the substrate. A top plate is attached to the substrate to define a channel that permits ink flow between the inlet side and the outlet side. The top plate has a plurality of variable size openings to permit ejection of acoustically impelled droplets of ink flowing in the channel. Because of the varying size of the openings in the top plate, the ink menisci in the plurality of openings is maintained at a substantially constant distance with respect to the substrate, improving uniformity of droplets ejected.

3 Claims, 4 Drawing Sheets

ACOUSTIC INK PRINTHEAD WITH VARIABLE SIZE DROPLET EJECTION OPENINGS

The present invention relates generally to acoustic ink printers with lenses for focusing acoustic energy. More particularly, the present invention relates to an acoustic ink printer head having an ink filled channel overlaying fresnel lenses positioned along the channel.

BACKGROUND AND SUMMARY OF THE INVENTION

Acoustic printing systems provide a nozzle less alternative to conventional thermal ink jet systems. Instead of supporting a large number of easily clogged nozzles, acoustic printing systems typically use an ink covered printhead that supports multiple acoustic lenses. Each of the acoustic lens attached to the printhead can focus a beam of sound energy against a free surface of the ink. This focused acoustic beam exerts sufficient acoustic radiation pressure against the surface to cause ejection of individual droplets of ink, which are directed to impact upon a sheet of paper or other printing medium.

Precise control of droplets ejected by acoustic ink printheads conventionally is performed by independently modulating the rf excitation of acoustic radiators acoustically coupled to the acoustic lenses. The acoustic radiators (commonly piezoelectric transducers) are amplitude or pulse width modulated in accordance with a desired input pattern that typically corresponds to pixel level representations of text or imagery. Modulating the transducers in this defined input pattern transiently increases the acoustic radiation pressure which each of the beams continuously exerts against the free ink surface, generating brief, controlled excursions to a sufficiently high pressure level for overcoming the ink restraining force of surface tension. These transient overpressures cause individual droplets of ink to be ejected from the free ink surface at a sufficient velocity to cause deposition in a desired image configuration on a nearby printing medium. Advantageously, acoustic ink printing does not rely upon easily clogged nozzles or small ejection orifices, eliminating mechanical constraints that cause many of the reliability and pixel placement accuracy problems in conventional drop on demand or continuous stream ink jet printers. In addition, because of the lack of nozzles and the absence of generated heat (as compared to thermal ink jet systems) non-traditional inks and even viscous coatings such polymers or photoresist can be applied to surfaces using acoustic ejection.

For best operation an acoustic ink printhead must be supplied with a constant and consistent flow of ink to present a stable ink ejection surface. Use of a flowing and appropriately filtered ink supply system also simplifies stabilization of ink temperature, keeps the ink free of various contaminants, and encourages mixing of ink constituents to minimize adverse differential ink evaporation effects that may reduce uniformity of the ink composition and the associated uniformity of droplet ejection.

Unfortunately, one problem with a flowing ink supply relates to equalization of hydrostatic pressure of the free ink surfaces associated with each acoustic lens. Differing hydrostatic pressures resulting from frictional resistance to fluid flow leads to differing distances between the free surface of the ink and each acoustic lens. If this change in distance is substantial (eg. greater than several microns), an individual acoustic lens in an array of identical lenses may be focused above or below the free surface of the ink, rather than at the surface, eliminating uniformity of droplet ejection, and reducing print reliability. Equalization of pressure may be relatively simple with a small number of lenses and consequently limited ink flow path, but as the number of lenses increases (and with it the required free surface ink flow path) in higher-performance and higher resolution printers, the ink supply system for delivering ink to the lenses becomes more complex and the equalization of pressure at each lens more difficult.

One contemplated solution to this problem involves compensating for the change in hydrostatic pressure by adjustment of the focal length of the acoustic lenses. Typically, the focal length of acoustic lenses positioned adjacent to the ink outlet is defined to be less than the focal length of acoustic lenses positioned adjacent to the ink inlet. In those acoustic printhead designs having a continuous pressure drop along all definable paths between the ink inlet and the ink outlet, the focal length of the acoustic lenses sequentially decreases between the ink inlet and the ink outlet to compensate for the progressive reduction in surface level of the ink. Each acoustic lens in an array of acoustic lenses is adjusted to have a focal length that ensures focusing a predefined acoustic frequency at the surface level of ink flowing above the respective lens, consequently reducing non-uniformity in droplet size, speed, and travel characteristics.

However, the foregoing solution requires design and manufacture of a large number of differing focal length acoustic lens. High tolerances must be maintained for each of the acoustic lens, and testing the actual focal length of the lenses system without putting ink into the system is difficult. An easy to manufacture, test, and adjust solution to the problem of hydrostatic pressure drop in acoustic ink printheads is still required.

Accordingly, the present invention provides an apparatus that substantially mitigates the problem of pressure equalization of the free ink surfaces in an acoustic ink printer with a constant flow ink transport system. An acoustic fluid ejection apparatus capable of ejecting fluids such as ink includes a plurality of acoustic lenses (typically multiphase fresnel lenses) supported by a substrate. A top plate having multiple variable sized openings through which fluid can be ejected is positioned adjacent to the substrate to form a channel configured to receive fluid, with the channel formed therebetween varying in dimensions between a fluid inlet and a fluid outlet. The size of the openings is selected to compensate for the pressure drop and reduction in surface level in fluid flowing through the channel, permitting the meniscus height of fluid in the openings to be maintained substantially constant with respect to the substrate. In preferred embodiments, many channels are used to speed overall ejection rate, with each channel being connected to an inlet manifold and an outlet manifold. In addition, a fluid pump can be employed to recirculate fluid from the fluid outlet back to the fluid inlet.

Use of an acoustic ejection system has many advantages when the fluid considered is an ink. Accordingly, the present invention provides for an acoustic ink printhead that includes a substrate coated with an ink layer having an ink surface, with a substantially constant distance between the substrate and the ink surface being maintained. A plurality of acoustic lenses are defined in the substrate, with each acoustic lens having an identical predefined focal length, and a top plate is positioned adjacent to the substrate to define a channel for the ink layer, the top plate being arranged to varying sized. As will be appreciated, these varying sized openings can be selected to approximately compensate for the sequential decrease in pressure (fluid pressure drop) in an ink layer flowing between an inlet manifold to the channel and the outlet manifold from the channel.

Application of the present invention ensures focusing a predefined acoustic frequency at the surface level of ink flowing above the respective lens, consequently reducing non-uniformity in droplet size, speed, and travel characteristics. As will be appreciated, the present invention is of particular utility for use in conjunction with acoustic printhead systems having linear geometries. For example, an acoustic ink printhead that includes a plurality of channels configured to receive ink has essentially linear hydrostatic characteristics in each channel, with the free surface level diminishing along the channel between the inlet and outlet. This is particularly true when each channel is connected to a common inlet manifold and a common outlet manifold, so that inlet pressure and outlet pressure (and ink flow velocity) in all channels is substantially equal.

A linear array of channels with a sequentially decreasing hydrostatic pressure easily supports use of identical acoustic lenses constructed as multiphase fresnel lenses. Standard semiconductor integrated circuit techniques are available for fabricating these lenses in compliance with design specifications. Such construction permits relatively tight tolerances, allowing for integrated lens arrays demanding substantial precision in the relative spatial positioning of several lenses. The diffractive performance of these lenses simulate concave refractive lenses, even though the lenses provided by this invention preferably have generally flat geometries. Use of fresnel lenses simplifies machining, etching, growing, or otherwise depositing an acoustic lens having the required focal length on a flat surface such as a channel bottom of an acoustic printhead.

Other objects and advantages of the present invention will become apparent to those skilled in the art upon consideration of the following description of the drawings and preferred embodiments.

DETAILED DESCRIPTION OF THE INVENTION

Figure 1:
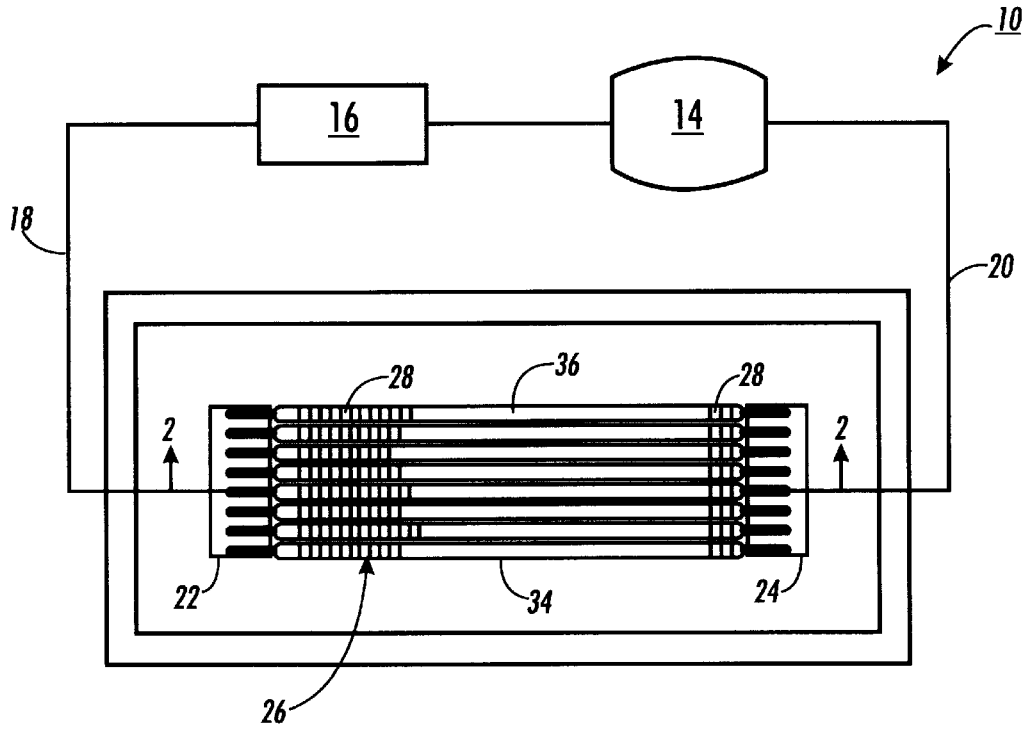
FIG. 1 schematically illustrates an acoustic ink printhead system with an ink pump, ink heater, and a printhead that allows ink to flow from an ink inlet manifold, through a plurality of channels, and out through an ink outlet manifold for recirculation through the ink pump and heater.
Figure 2:
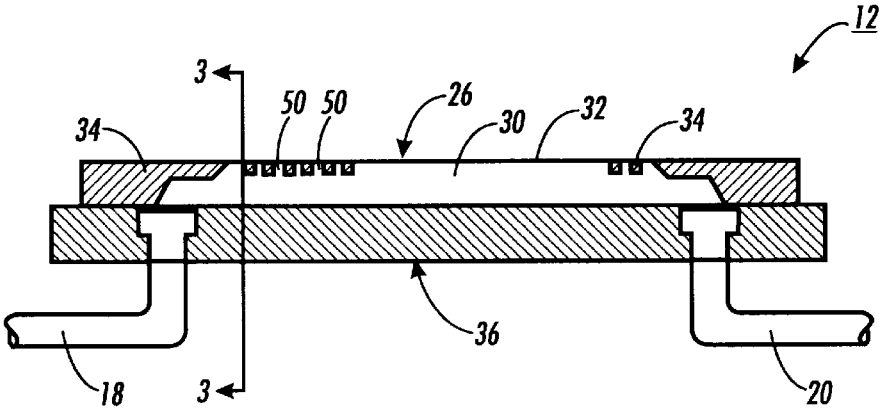
FIG. 2 is a cross section along line 2—2 of FIG. 1, illustrating a channel having a free ink surface and a plurality of independently addressable acoustic lenses for ejecting a droplet from the ink surface directly above substrate positioned acoustic lenses.
Figure 3:
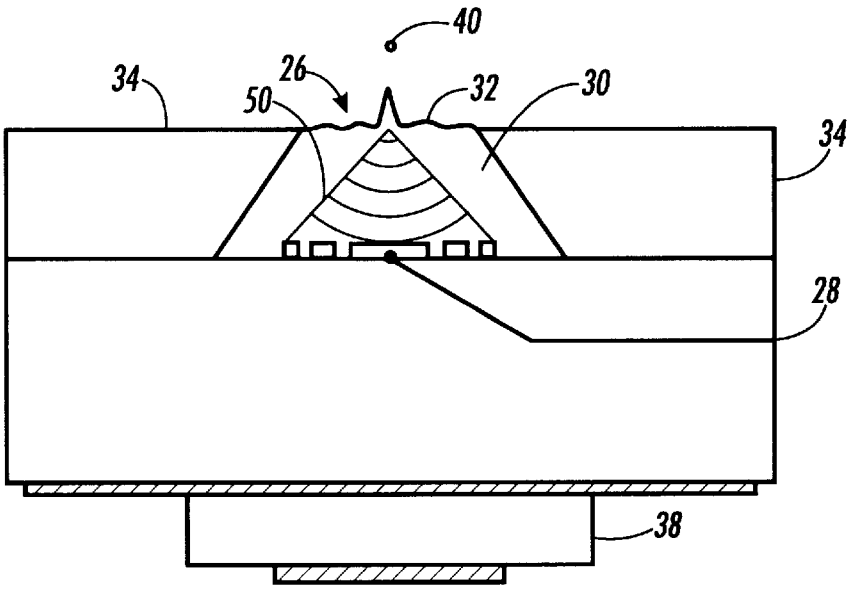
FIG. 3 is a schematic view along line 3—3 of FIG. 2, illustrating ejection of an ink droplet in response to application of a focused acoustic wave at the free surface of the ink.

An acoustic ink printhead system is illustrated in FIGS. 1, 2, and 3. As best seen in FIG. 1, the system 10 includes a printhead 12, with an inlet 18 and an outlet 20, coupled in fluid communication to an ink pump 14 and heater 16 for recirculation of ink. As will be appreciated by those skilled in the art, the term "ink" is intended to encompass a wide variety of fluid substances that can be ejected by the printhead 12 to coat a surface. This coating can be precisely controlled to present an image such as text or photographic reproduction, or even may allow for uniform or controlled coating of the entire surface. For the image presentation, black or colored inks can be employed, while controlled coating of material surfaces more typically involves use of polymeric coatings, protective chemical coatings, or even standard photoresists such as encountered in the semiconductor processing industry. Similarly, the term "printhead" is intended to cover the mechanism for delivery of ink as defined heretofore, and is not limited to delivery of such ink only for traditional printing applications as text reproduction or halftoning.

Figure 4:
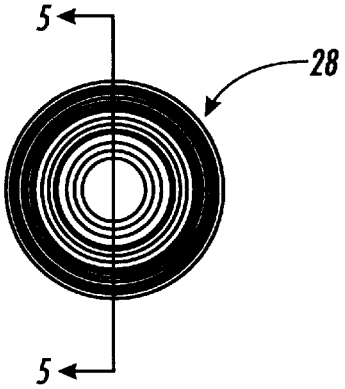
FIG. 4 is an enlarged top view of a planar fresnel lens for focusing acoustic waves in accordance with the present invention.
Figure 5:
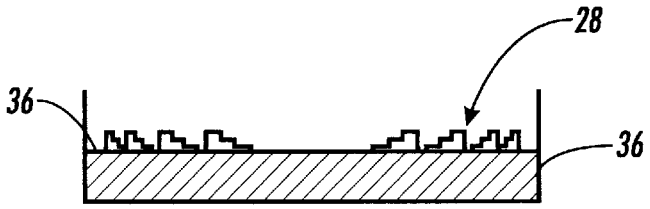
FIG. 5 is a cross section taken along line 5—5 of the fresnel lens of FIG. 4.

Ink entering the printhead 12 through inlet 18 is distributed by inlet manifold 22 to a plurality of longitudinally extending channels 26 formed in the printhead 12. Positioned along the channel on a substrate 36 are a large number of acoustic lenses 28, typically being a fresnel lens having a ring structure 42 such as shown in FIGS. 3–5 (alternative acoustic energy focusing structures can of course be employed, with spherical lenses being a preferred alternative). Functionally, the acoustic lenses 28 provide an array of electronically controlled ink ejectors that are capable of forcing ejection of an ink droplet from an ink surface in response to application of a suitable frequency and amplitude of focused acoustic energy. The ejected ink droplet can be directed to contact a surface such as a piece of paper, other recording medium, or a coatable material (not shown). After moving through the channels 26, the ink enters an outlet manifold 24 that funnels the ink to the outlet 20 for passage into pump 14. The ink is filtered and reheated by ink heater 16 to ensure maintenance of optimal flow characteristics, and again directed to enter the printhead through inlet 18.

As seen in schematic cross section in FIGS. 2 and 3 (and as seen, not to scale, in FIGS. 6, 7, and 8), the channels 26 in printhead 12 are exposed to atmospheric pressure. Each channel 26 is defined in part by a top plate 34 that supports a plurality of openings 50 through which ink is constrained by capillary effects, yet remains capable of being acoustically ejected (openings 50 are seen in FIG. 2 and are shown, not to scale, in FIGS. 6, 7, and 8 discussed later). The top plate 34 with its openings 50 is in turn integrally bonded to a glass substrate 36 supporting the acoustic lenses 28. Ink 30 having an ink surface 32 flows along the channel over the acoustic lenses 28, which are individually controlled by application of a matching number of transducers 38. The transducers 38 are positioned beneath the acoustic lenses 28 to supply acoustic energy that can be focused to emit an ink droplet 40.

Advantageously, the fresnel-type acoustic lenses 28 positioned at the base of the ink containing channels 26 can be fabricated through the use of a conventional photolithographic patterning process. For example, an acoustically flat layer of etchable material, such as a-Si, is grown or otherwise deposited on an acoustically flat face of an etch resistant substrate 36, such as a quartz or glass substrate. Using a photographic mask and conventional etching procedures known to those skilled in the art, a Fresnel lens having a desired pattern is then created. In fact, if the thickness of the a-Si layer can be controlled with sufficient precision while it is being deposited to yield an acoustically flat layer of a-Si having a thickness essentially equal to the height of the highest desired phase steps of the Fresnel lenses, no further pre-etch processing is required. However, it sometimes may be easier to first grow a somewhat thicker layer of a-Si on the substrate and to thereafter polish that a-Si layer down to the desired thickness and acoustical flatness. Alternatively, it is of course possible to employ a procedure such electron beam etching or other microfabrication techniques known to those skilled in the art to create an appropriate acoustic lens.

In operation, radiofrequency (rf) drive voltages are applied across the piezoelectric transducers 38 (by means not shown) on spatially separated centers each acoustically aligned with the acoustic lenses 28. The excited transducers 38 generate longitudinally propagating acoustic plane waves (schematically illustrated as waves 50 in FIG. 3) within the substrate 36 for substantially independent, axial illumination of each of the acoustic lenses at near normal angles of incidence. The acoustic lenses 28 are acoustically coupled to the ink 30, either directly (as shown in the Figures) or through an intermediate monolayer or multilayer acoustic coupling medium. In response to driving the transducers 38 at various amplitude levels in a predetermined pattern, text or images based on the pattern of ejected droplets on paper (or other suitable media) can be created. Alternatively, if the transducers 38 are continuously driven, smooth coatings can be applied to a surface.

For best results in creating text and images of a desired quality, it is important to ensure ejection of droplets having essentially uniform size, shape, and travel characteristics. This is achieved in part by consistently focusing acoustic energy at the same position relative to the ink surface 32. For maximum utilization of acoustic energy, it is generally best to focus the acoustic lenses at the ink surface, rather than above or below the ink surface, although alternative focal surfaces can of course be used. In typical example, the surface of the ink directly above each acoustic lens/transducer combination is taken to define a desired focus point. This focal point changes along the channel, because the distance between the ink surface 32 and the base of the channel 26 diminishes as a function of the corresponding pressure drop (attributable mainly to fluid resistance against walls and bottom of the channel) between the inlet 18 and the outlet 20. To compensate, a suitable mechanism must be employed to maintain focus of the acoustic lenses 28 at designated positions on the ink surface 32 along the channel, even though a pressure drop corresponding to an ink surface level drop of fifty (50) microns or more may exist in the channel between inlet and outlet.

Figure 6:
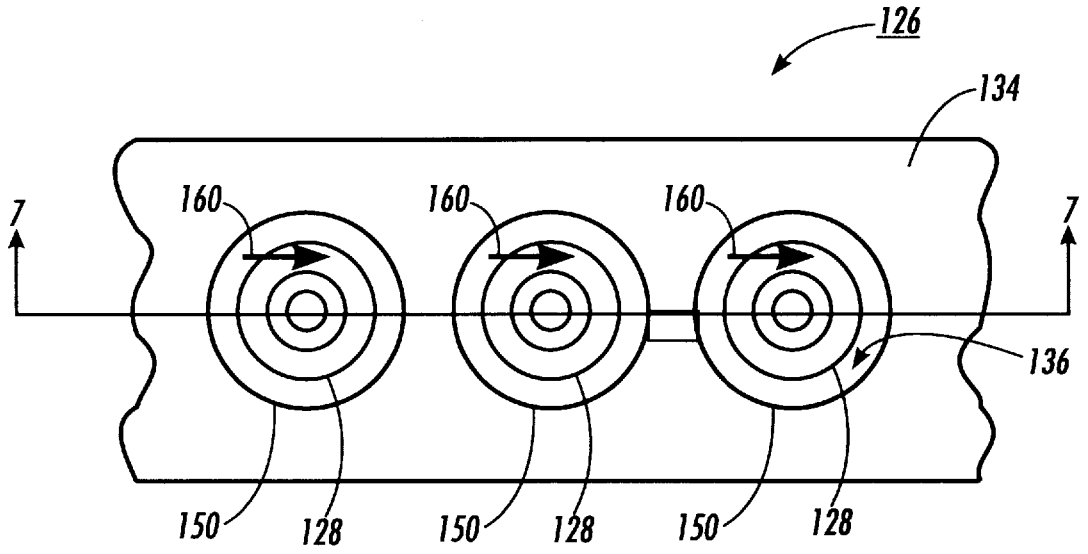
FIG. 6 is a not to scale top view of a top plate having openings positioned over a substrate supporting acoustic lenses.
Figure 7:
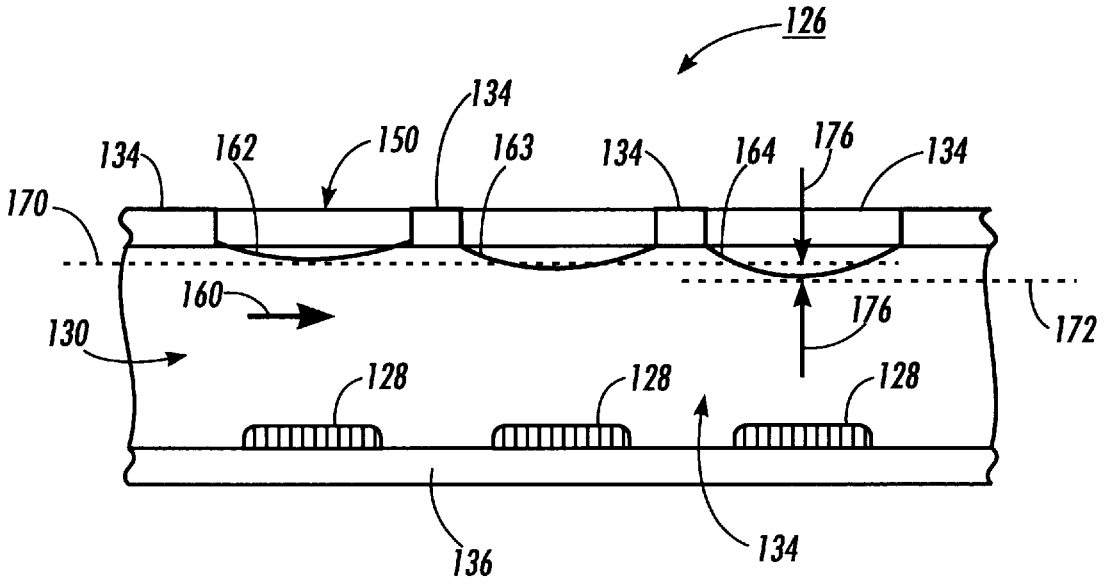
FIG. 7 is a not to scale cross section taken along line 7—7 of FIG. 6 to illustrate the variance in fluid meniscus height for ink flowing through an ink printhead system that does not compensate for pressure drop in the flow direction.

The problem of ink surface level drop is best illustrated in FIGS. 6 and 7, which respectively illustrate a non-scaled portion of an ink channel 126 and the corresponding cross section taken therethrough. The vertical scale in these Figures is greatly exaggerated to better view the results of ink pressure drop in the ink flow direction 160. As can be seen, the ink channel 126 contains ink 130 moving in direction 160. The channel 126 is formed by the combination of a substrate 136 and a top plate 134. The substrate 136 has defined thereon a plurality of acoustic lenses 128, and is covered with the top plate 134 so that openings 150 in the top plate 134 are aligned above each acoustic lens 128. The openings 150 allow ejection of ink droplets (not shown) from the channel 126 (for orientation with respect to a similar structure, see FIG. 3 for an alternative view of a cross section through substrate 36 and top plate 34), and are substantially circular in the shown embodiment.

As can best be seen in cross section in FIG. 7, the ink menisci 162, 163, and 164 in openings 150 have a progressively decreasing radius of curvature in the ink flow direction 160. This is due to the decrease in pressure of ink flowing in channel 126, and is approximately quantified by the following relationship:

$$p_a - p_b = 2y/R$$

where $p_a$ is atmospheric pressure, $p_b$ is fluid pressure just below the ink surface, y is the surface tension, and R is the radius of curvature of the meniscus. Because of the resistance to fluid flow in the channel the $P_b$ upstream (eg. in the vicinity of meniscus 162) is greater than the $p_b$ downstream (eg. in the vicinity of meniscus 164). The height 170 (as measured from the base of meniscus 162 to the acoustic lens 128) is accordingly slightly higher than height 172 (as measured from the base of meniscus 164 to acoustic lens 128). In practice, this results in a height differential 176 (separated arrows in FIG. 7) that must be compensated for to ensure best results when transferring acoustic energy to the fluid to emit droplets.

Figure 8:
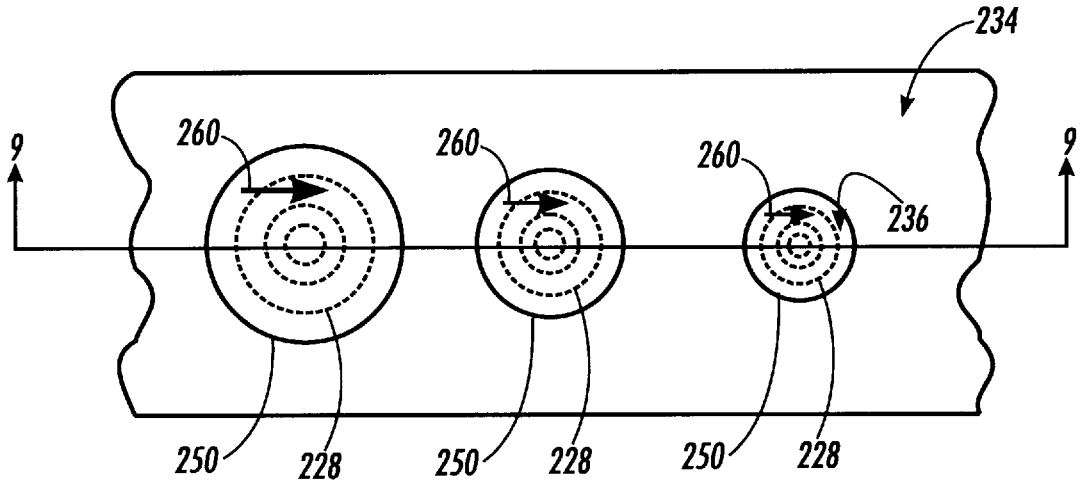
FIG. 8 is a not to scale top view of an ink printhead system in accordance with the present invention in which the top plate has variably sized openings to compensate for pressure drop in the flow direction.
Figure 9:
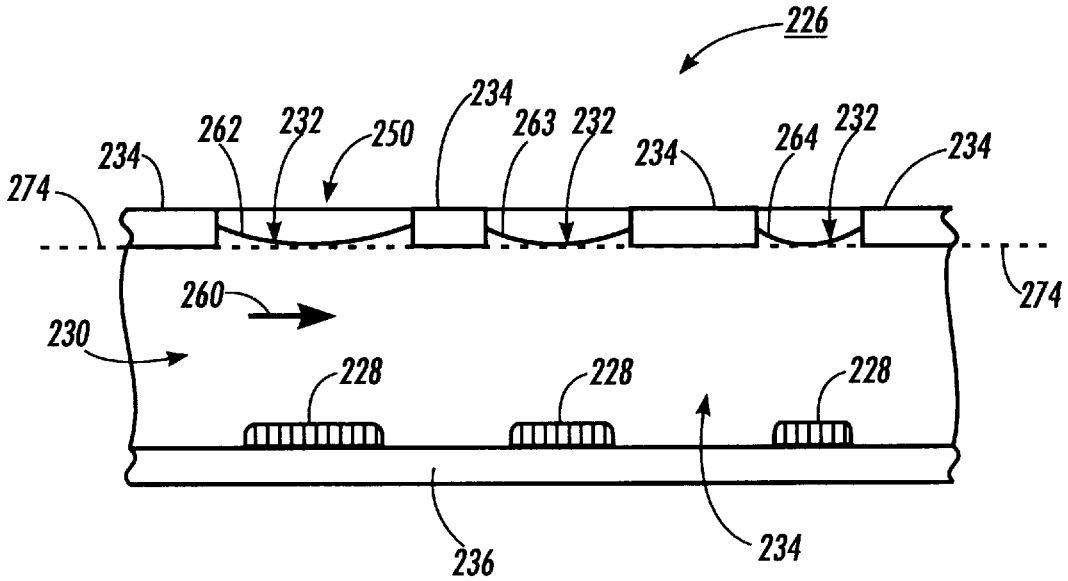
FIG. 9 is a not to scale cross section taken along line 9—9 of FIG. 8 to illustrate the identical fluid meniscus height for ink flowing through an ink printhead system having openings that compensate for pressure drop in the flow direction.

As best illustrated in FIGS. 8 and 9, the present invention alleviates the problems associated with pressure drop along the ink channels 226 by providing variable sized openings that compensate for pressure drop by supporting menisci having the same height above the substrate. In a manner similar to that described in conjunction with FIGS. 6 and 7, the vertical scale in FIG. 8 is greatly exaggerated to better view the results of ink pressure drop in the ink flow direction 260. As can be seen, the ink channel 226 contains ink 230 moving in direction 260. The channel 226 is formed by the combination of a substantially flat substrate 236 and top plate 234. The substrate 236 has defined thereon a plurality of acoustic lenses 228, and is covered with the top plate 234 so that variable sized openings 250 are aligned above each acoustic lens 128. The variable sized openings 150 allow ejection of ink droplets (not shown) from ink surface 232 of the channel 226, and are substantially circular in the shown embodiment.

Because the variable size openings 150 having a radius selected to compensate for the pressure drop along the channel 226, the ink menisci 262, 263, and 264 in openings 250 have a height 274 (indicated by the dotted line) from the base of the menisci 262, 263, and 264 to the substrate supported acoustic lenses 228 that is substantially constant. As will be appreciated by those skilled in the art, the exact dimensions of the openings 250 may be adjusted according to the variety of ink used, atmospheric conditions, and operating pressure of ink pumps.

In addition to the foregoing embodiment of the invention, as those skilled in the art will again appreciate it is possible to use alternative mechanisms for adjusting the relative height of the menisci, including use of a wedge shaped top plate and a flat top plate, wedge shaped substrate and a flat top plate, or even stepped top plate structures that approximately compensate for all or part of the change in meniscus height along the channel. Other mechanisms for selectively varying meniscus height can also be employed, including adjusting the focal length of the acoustic lenses to compensate for the pressure drop as needed when changing meniscus height is not desirable.

While the present invention has been described in conjunction with specific embodiments thereof, it is evident that many alternatives, modifications, and variations will be apparent to those skilled in the art. Accordingly, the various embodiments described herein should be considered illustrative, and not limiting the scope of the present invention as defined in the following claims.

The claimed invention is:

1. An acoustic ink printhead comprising:

a substrate, a plurality of acoustic lenses provided on the substrate, each acoustic lens having an identical predefined focal length, and a top plate positioned in fixed spacial relationship adjacent to the substrate to define an ink channel for flow of ink having a surface area, the top plate having a plurality of variable size openings defined therethrough, said surface area of the ink flows over the acoustic lenses and the openings in the top plate, the surface area adjacent the top plate providing ink menisci within each of the plurality of variable size openings suspended by the top plate at substantially identical distances from the substrate, and wherein the size of the plurality of variable size openings sequentially decreases in a direction of the ink flow to compensate for a pressure drop in the ink flowing through the channel.

2. An acoustic fluid ejection apparatus comprising a substrate having an inlet side and an outlet side, a plurality of acoustic lenses acoustically coupled to the substrate, each acoustic lens having an identical focal length for focusing acoustic energy at an associated position adjacent to the substrate, a top plate attached in fixed spacial relationship to the substrate to define a channel therethrough, the top plate having a plurality of openings of progressively decreasing size in a direction of ink flow, with each opening positioned above a corresponding acoustic lens, the plurality of openings having top plate supported fluid menisci arranged to lie at a substantially constant distance from the corresponding acoustic lens to improve uniformity of ejection of acoustically impelled fluid.

3. The acoustic fluid ejection apparatus of claim 2, wherein the substrate is etched to define said plurality of acoustic lenses.

* * * * *